US012137758B1

(12) United States Patent
Fehr

(10) Patent No.: US 12,137,758 B1
(45) Date of Patent: Nov. 12, 2024

(54) KNEE PROTECTION ASSEMBLY

(71) Applicant: Jacob Epp Fehr, Aylmer (CA)

(72) Inventor: Jacob Epp Fehr, Aylmer (CA)

( * ) Notice: Subject to any disclaimer, the term of this patent is extended or adjusted under 35 U.S.C. 154(b) by 2 days.

(21) Appl. No.: 18/144,911

(22) Filed: May 9, 2023

(51) Int. Cl.
*A41D 13/06* (2006.01)
*A41D 13/00* (2006.01)

(52) U.S. Cl.
CPC ..... *A41D 13/065* (2013.01)

(58) Field of Classification Search
CPC ..... A41D 13/065
See application file for complete search history.

(56) References Cited

U.S. PATENT DOCUMENTS 1,269,829 A * 6/1918 Landon ..... A41D 13/065 2/24
1,510,325 A * 9/1924 Landon ..... A41F 11/02 2/24
4,408,600 A * 10/1983 Davis ..... A61F 5/0106 2/22
4,685,153 A * 8/1987 Sims ..... A41D 13/065 2/24
D341,228 S 11/1993 Loftin
5,537,689 A * 7/1996 Dancyger ..... A41D 13/0568 2/24
5,652,957 A * 8/1997 Williford ..... A41D 13/05 2/22
5,915,529 A * 6/1999 Popowski ..... A41D 13/08 2/24
5,987,643 A * 11/1999 Beutler ..... A41D 13/0562 2/24
6,029,273 A * 2/2000 McCrane ..... A41D 13/065 2/24
6,551,264 B1 * 4/2003 Cawley ..... A61F 5/0125 128/882
6,802,080 B2 10/2004 Hawley
7,096,507 B1 * 8/2006 Bolden ..... A41D 13/05 2/24
7,194,770 B1 * 3/2007 Fecenko ..... A41D 1/06 2/227
7,578,800 B2 * 8/2009 Castillo ..... A61F 5/0123 602/5
7,707,649 B2 * 5/2010 Dancyger ..... A41D 13/0568 2/24
8,141,170 B2 * 3/2012 Paterno ..... A41D 13/065 2/24

(Continued)

FOREIGN PATENT DOCUMENTS

WO 2014107478 7/2014

*Primary Examiner* — Robert H Muromoto, Jr.
(74) *Attorney, Agent, or Firm* — Kyle A. Fletcher, Esq.

(57) ABSTRACT

The knee protection assembly includes a knee pad, a pair of leg straps, and a pair of boot straps. The knee pad may be adapted to be worn by a user to protect a user's knee. As a non-limiting example, the knee pad may be worn by a worker who must kneel to perform a work task. The knee pad may be adapted to cover the front of the user's knee. The knee pad may be held in place by the pair of leg straps. The pair of boot straps may be adapted to couple the knee pad to a work boot in order to prevent the knee pad from riding up a user's leg when working on a pitched roof. Two of the knee pads may be worn as a pair—one for each of the user's knees.

17 Claims, 5 Drawing Sheets

(56) References Cited

U.S. PATENT DOCUMENTS 8,220,073 B2 * 7/2012 Lopez ..... A41D 13/065 2/24
9,144,253 B1 * 9/2015 Munter ..... A41D 13/065
9,655,391 B2 * 5/2017 Carver ..... A41D 13/065
9,861,144 B2 * 1/2018 Carver ..... A41D 13/065
10,517,337 B2 12/2019 Marella
11,019,858 B1 * 6/2021 Freixas ..... A41D 13/06
2005/0277859 A1 * 12/2005 Carlsmith ..... A61F 5/0125 602/20
2006/0107433 A1 * 5/2006 Olson ..... A63B 71/08 2/22
2006/0137071 A1 * 6/2006 Rampersad ..... A41D 13/0556 2/24
2007/0163025 A1 * 7/2007 Godshaw ..... A41D 13/0568 2/24
2008/0072359 A1 * 3/2008 Godshaw ..... A41D 13/00 2/24
2008/0115248 A1 * 5/2008 Meadows ..... A41D 13/065 2/22
2008/0178360 A1 * 7/2008 Nascimento ..... A63B 71/1225 2/22
2009/0083901 A1 * 4/2009 Pardillo ..... A41D 13/065 2/455
2009/0151039 A1 6/2009 Kielland
2010/0095422 A1 * 4/2010 Lopez ..... A41D 13/065 2/24
2010/0107291 A1 * 5/2010 Carter ..... F41H 1/02 2/2.5
2010/0192269 A1 * 8/2010 Saranga ..... A41D 13/0568 2/24
2010/0235960 A1 * 9/2010 Johnson ..... A41D 13/065 2/24
2011/0094001 A1 * 4/2011 Maldonado ..... A41D 13/065 2/24
2012/0011632 A1 * 1/2012 Guiney ..... A63B 71/12 2/24
2012/0233736 A1 * 9/2012 Tepper ..... A41D 13/0153 2/24
2013/0025017 A1 * 1/2013 Chen ..... A63B 71/1225 2/22
2014/0182041 A1 * 7/2014 Archuleta ..... A41D 13/065 2/24
2014/0208490 A1 * 7/2014 Freixas ..... A41D 13/0568 2/455
2014/0237696 A1 * 8/2014 Carver ..... A41D 13/08 2/24
2014/0283275 A1 * 9/2014 Pratson ..... A41D 13/065 2/24

* cited by examiner

KNEE PROTECTION ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of protective gear, more specifically, a knee protection assembly.

SUMMARY OF INVENTION

The knee protection assembly comprises a knee pad, a pair of leg straps, and a pair of boot straps. The knee pad may be adapted to be worn by a user to protect a user's knee. As a non-limiting example, the knee pad may be worn by a worker who must kneel to perform a work task. The knee pad may be adapted to cover the front of the user's knee. The knee pad may be held in place by the pair of leg straps. The pair of boot straps may be adapted to couple the knee pad to a work boot in order to prevent the knee pad from riding up a user's leg when working on a pitched roof. Two of the knee pads may be worn as a pair-one for each of the user's knees.

An object of the invention is to provide a protective cover pad for a user's knee.

Another object of the invention is to provide a pair of leg straps to hold the knee pad in place.

A further object of the invention is to provide a pair of boot straps that couple between the knee pad and the user's work boot to prevent the knee pad from riding up when the user is working on a pitched roof.

Yet another object of the invention is to provide adjustable length straps that open for donning and removal.

These together with additional objects, features and advantages of the knee protection assembly will be readily apparent to those of ordinary skill in the art upon reading the following detailed description of the presently preferred, but nonetheless illustrative, embodiments when taken in conjunction with the accompanying drawings.

In this respect, before explaining the current embodiments of the knee protection assembly in detail, it is to be understood that the knee protection assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the knee protection assembly.

It is therefore important that the claims be regarded as including such equivalent construction insofar as they do not depart from the spirit and scope of the knee protection assembly. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims. 19

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
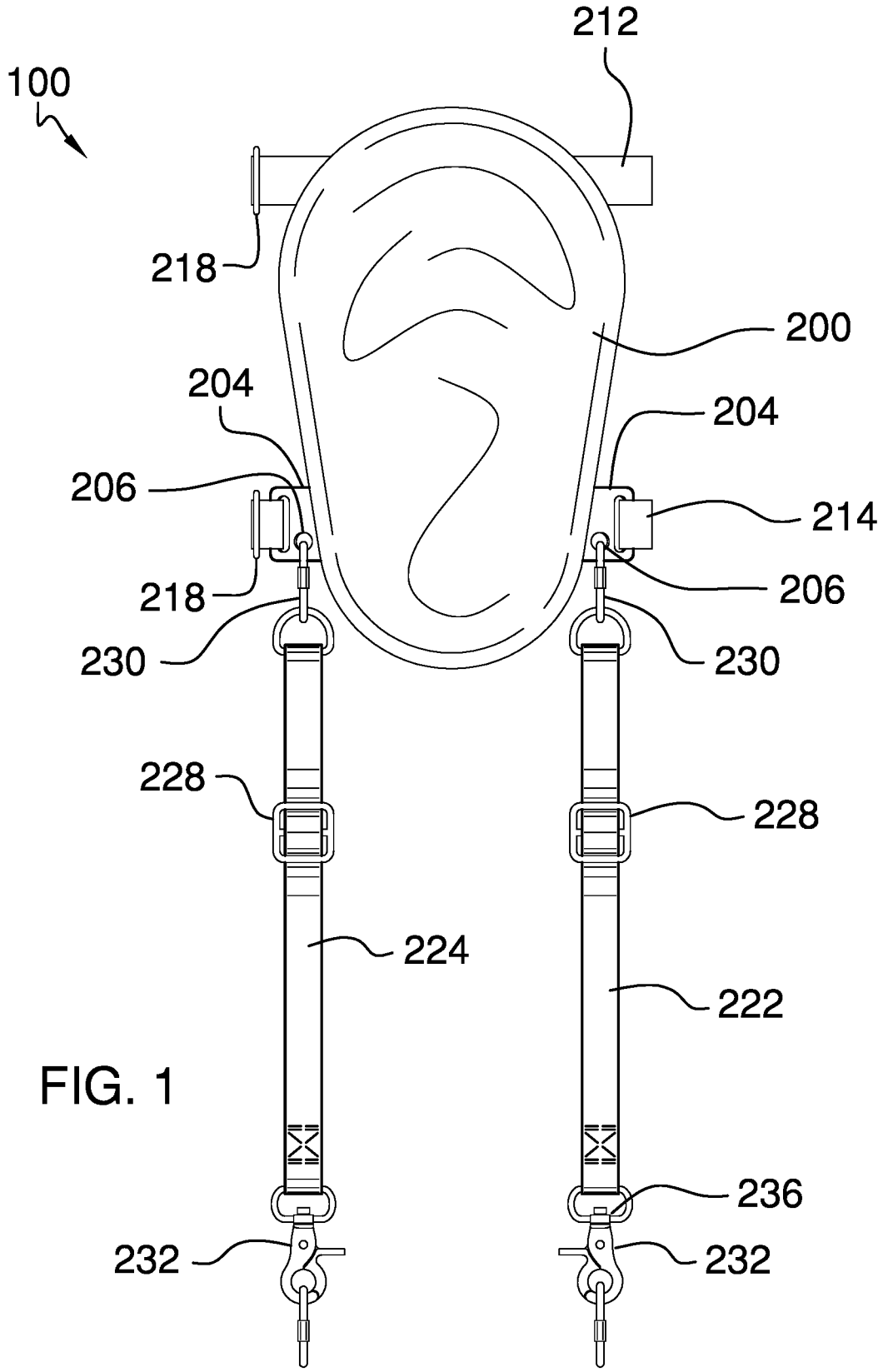
FIG. 1 is a front view of an embodiment of the disclosure.
Figure 2:
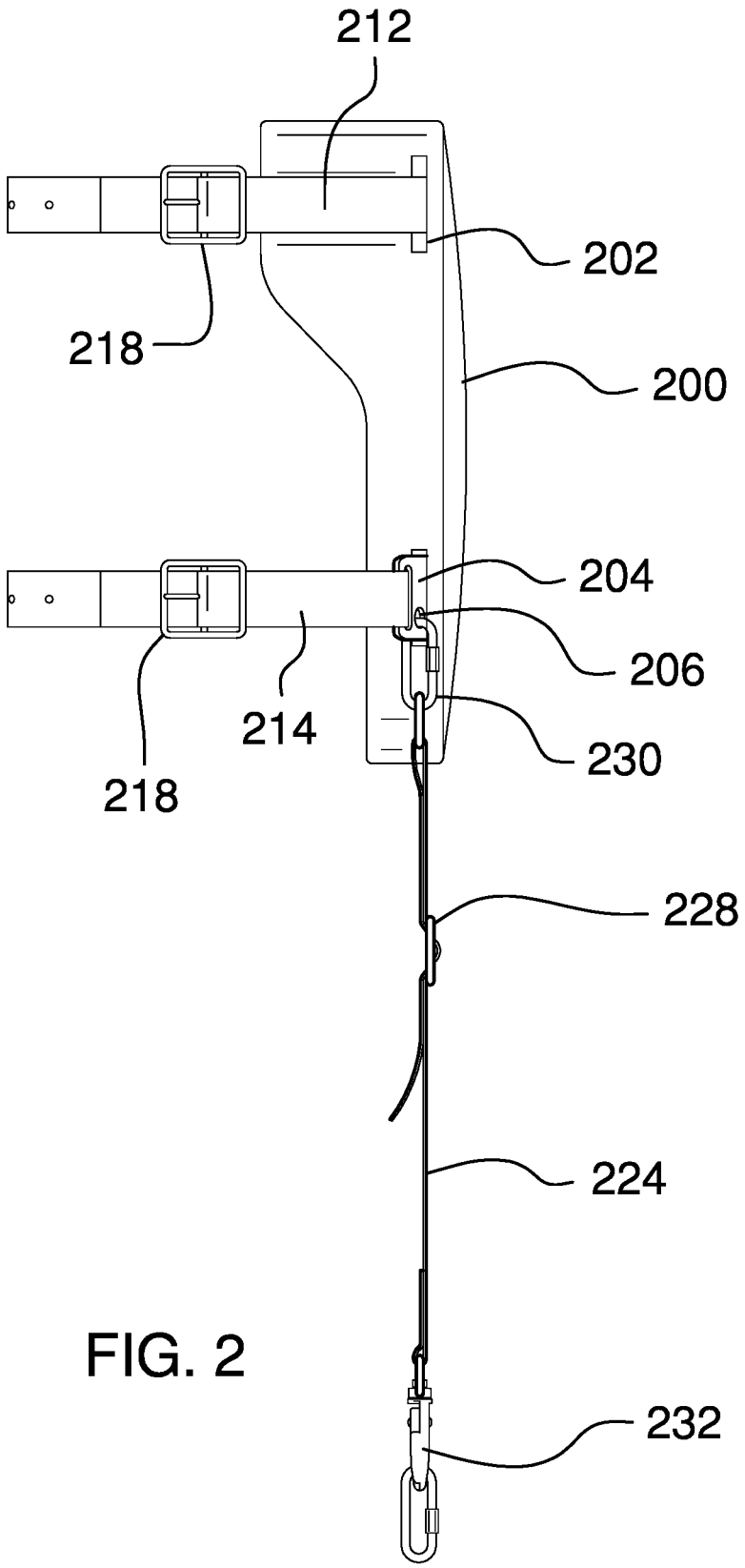
FIG. 2 is a right side view of an embodiment of the disclosure.
Figure 3:
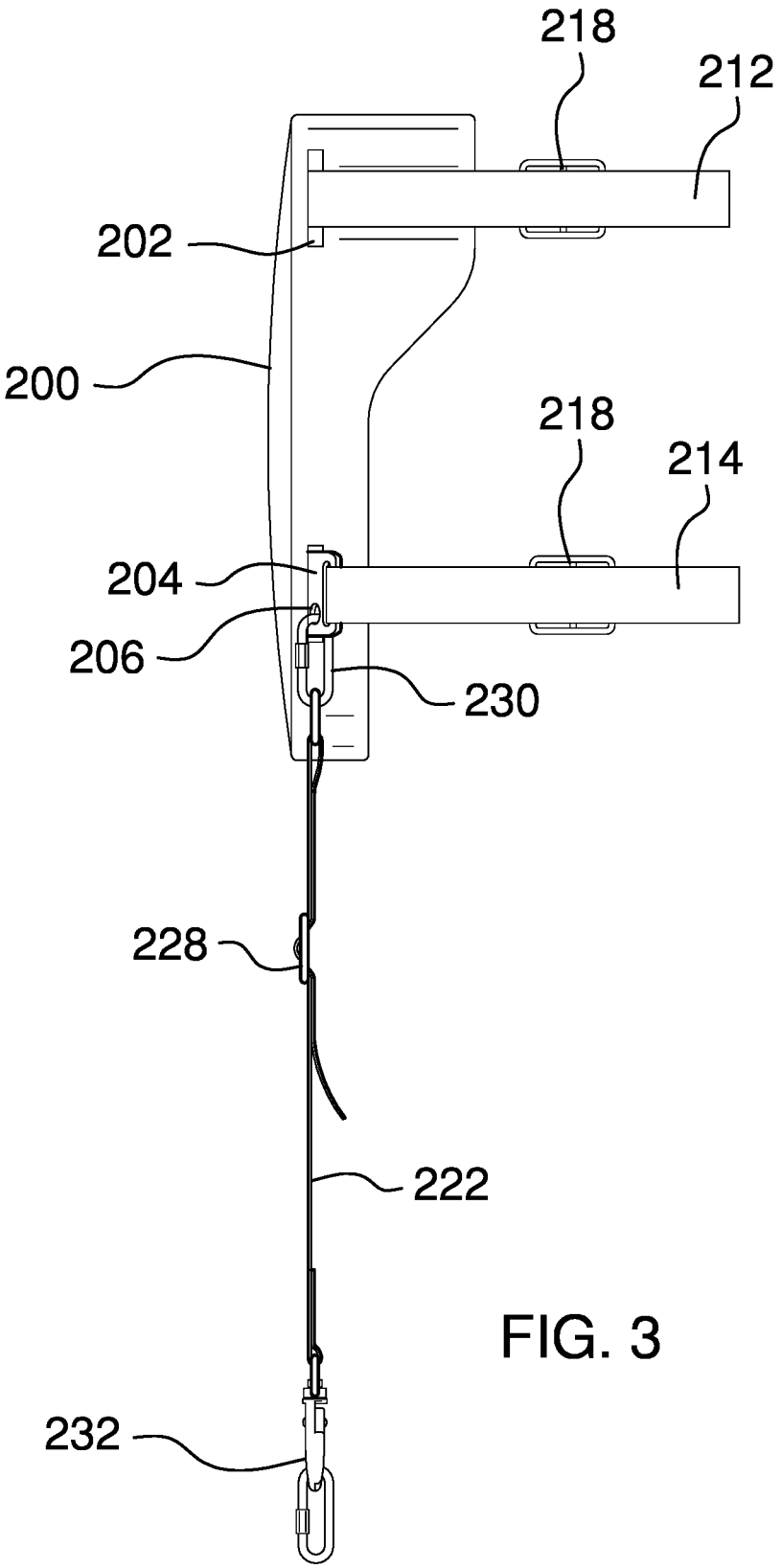
FIG. 3 is a left side view of an embodiment of the disclosure.
Figure 4:
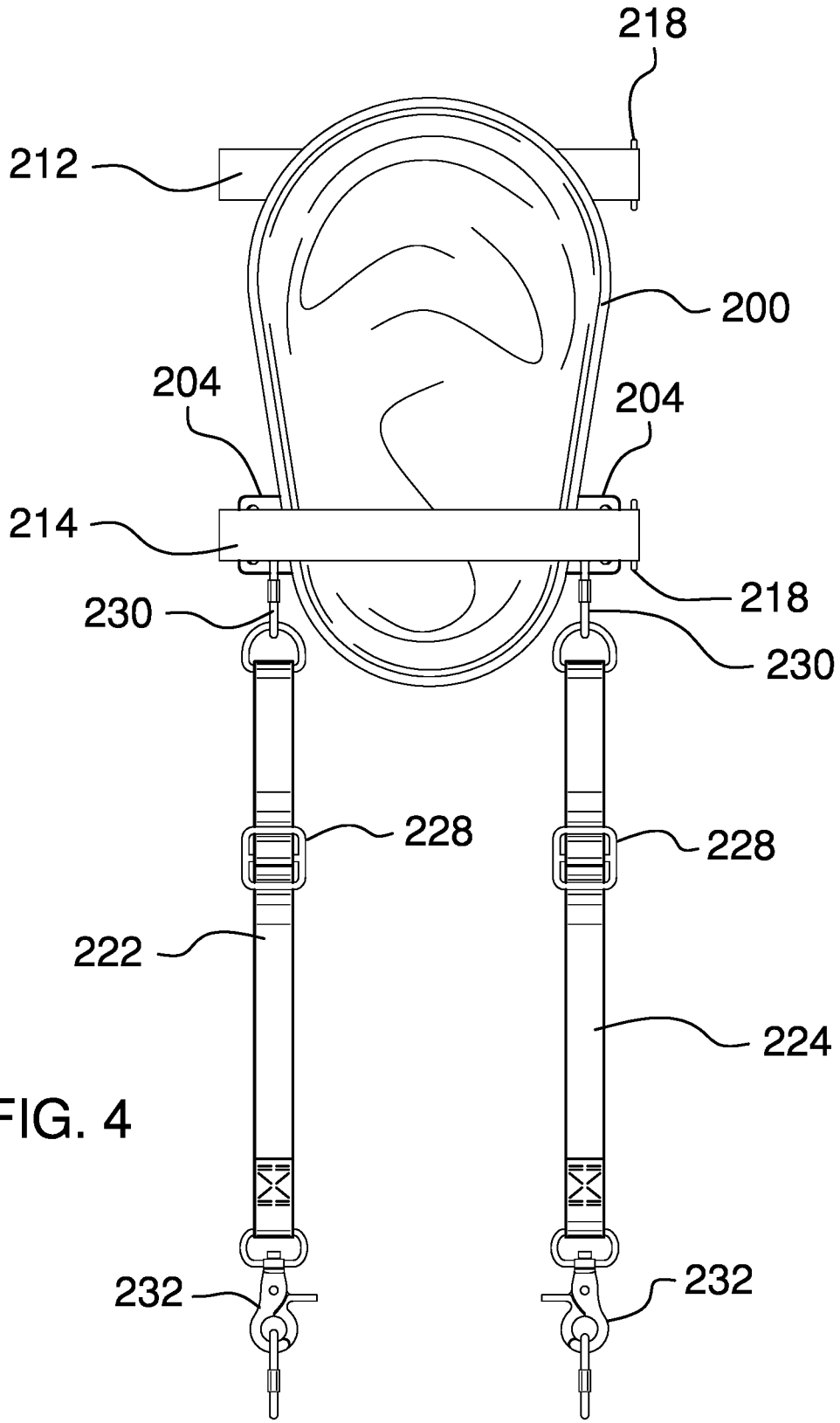
FIG. 4 is a rear view of an embodiment of the disclosure.
Figure 5:
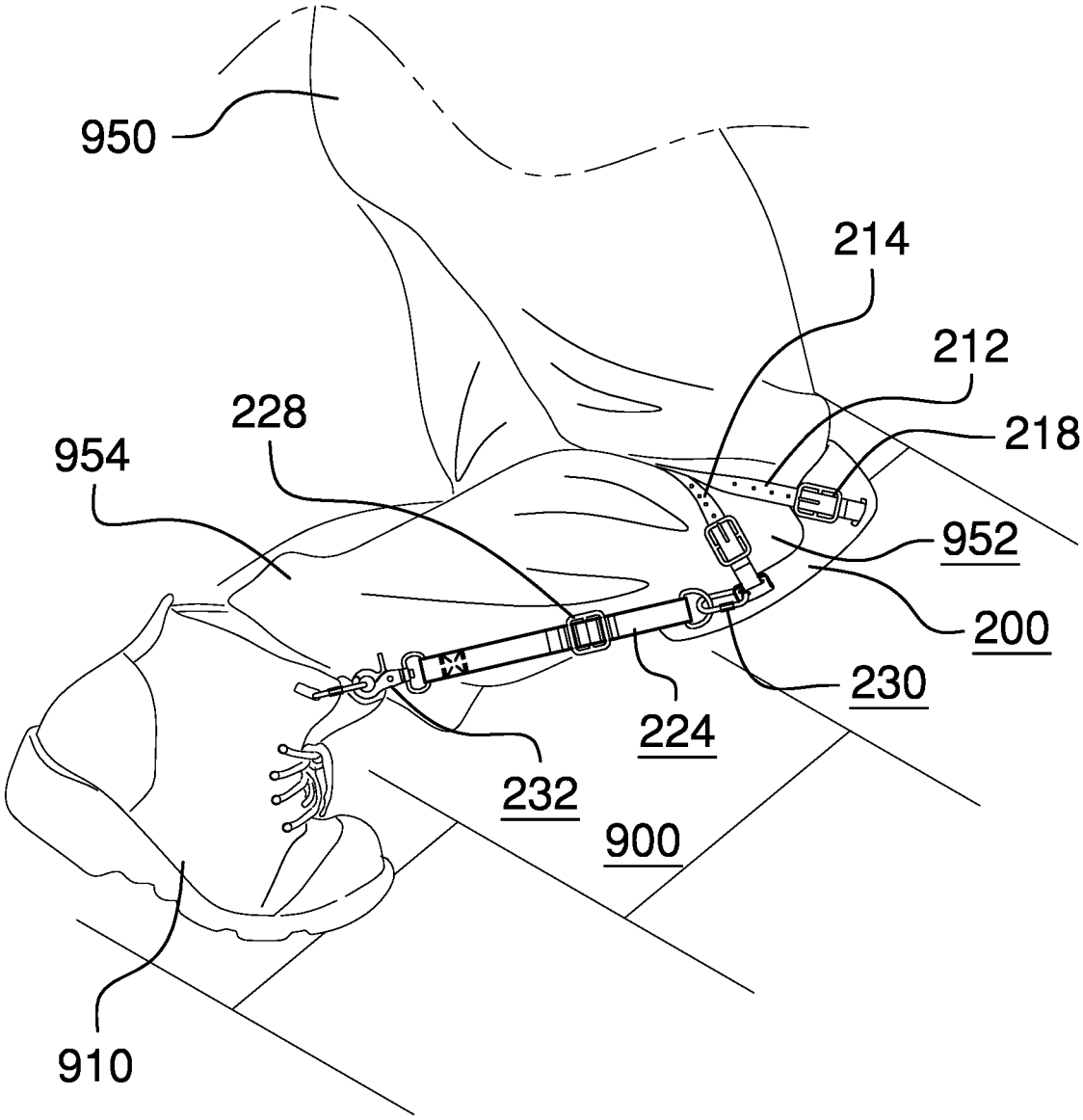
FIG. 5 is an in-use view of an embodiment of the disclosure.

Detailed reference will now be made to a first potential embodiment of the disclosure, which is illustrated in FIGS. 1 through 5.

The knee protection assembly 100 (hereinafter invention) comprises a knee pad 200, a pair of leg straps, and a pair of boot straps. The knee pad 200 may be adapted to be worn by a user 950 to protect a user's knee 952. As a non-limiting example, the knee pad 200 may be worn by a worker who must kneel to perform a work task. The knee pad 200 may be adapted to cover the front of the user's knee 952. The knee pad 200 may be held in place by the pair of leg straps. The pair of boot straps May be adapted to couple the knee pad 200 to a work boot 910 in order to prevent the knee pad 200 from riding up a user's leg 954 when working on a pitched roof 900. Two of the knee pads 200 may be worn as a pair—one for each of the user's knees 952.

The knee pad 200 may be a covering adapted to fit over the front of the user's knee 952. The knee pad 200 may be padded such that the knee pad 200 is adapted to cushion the user's knee while kneeling. In some embodiments, the knee pad 200 may be oblong and rounded. As non-limiting examples, the knee pad 200 may be elliptical or oval-shaped as seen from the front.

Viewed from the rear side, the knee pad 200 may be concave such that the knee pad 200 is adapted for the user's knee 952 to fit into the knee pad 200 when the user's knee 952 is bent. The knee pad 200 may be held in place by the pair of leg straps.

The knee pad 200 may comprise a plurality of upper strap interfaces 202 located on the top sides of the knee pad 200. An upper leg strap 212 may couple to the plurality of upper strap interfaces 202 to retain the upper leg strap 212. As a non-limiting example, the plurality of upper strap interfaces 202 may be slots that the upper leg strap 212 may pass through.

The knee pad 200 may comprise a plurality of lower strap interfaces 204 located on the bottom sides of the knee pad 200. A lower leg strap 214 may couple to the plurality of lower strap interfaces 204 to retain the lower leg strap 214. As a non-limiting example, the plurality of lower strap interfaces 204 may be slotted tabs that the lower leg strap 214 may pass through. Each of the plurality of lower strap interfaces 204 may comprise a boot strap aperture 206 for coupling the pair of boot straps to the knee pad 200.

The pair of leg straps may comprise the upper leg strap 212 and the lower leg strap 214. The upper leg strap 212 may be a flexible, horizontally-oriented strap adapted to encircle the back of the user's leg 954 above the user's knee 952. Both ends of the upper leg strap 212 may couple to the knee pad 200. The lower leg strap 214 may be a flexible, horizontally-oriented strap adapted to encircle the back of the user's leg 954 below the user's knee 952. Both ends of the lower leg strap 214 May couple to the knee pad 200.

An individual leg strap selected from the upper leg strap and the lower leg strap 214 may separate at a leg strap fastener 218 for donning and removal. The leg strap fastener 218 may be operable to adjust the length of the individual leg strap. As a non-limiting example, the leg strap fastener 218 May be a leg strap buckle.

The pair of boot straps may comprise a left side boot strap and a right side boot strap 224. The left side boot strap and the right side boot strap 224 may be a flexible, vertically-oriented straps adapted to prevent the knee pad 200 from riding up the user's leg 954. As a non-limiting example, as the user 950 moves downward on the pitched roof 900 while kneeling, the pair of boot straps may prevent the knee pad 200 from being pushed upwards on the user's leg 954. The tops of the left side boot strap 222 and the right side boot strap 224 may couple to the knee pad 200. The bottoms of the left side boot strap 222 and the right side boot strap 224 may couple to the work boot 910. The left side boot strap 222 may be coupled to the bottom left side of the knee pad 200. The right side boot strap 224 may be coupled to the bottom right side of the knee pad 200.

An individual boot strap selected from the left side boot strap 222 and the right side boot strap 224 may separate at a boot strap fastener 228 for donning and removal. The boot strap fastener 228 may be operable to adjust the length of the individual boot strap. As a non-limiting example, the boot strap fastener 228 may be a boot strap buckle. 13

The top of the individual boot strap may comprise a top coupler 230 for detachably coupling to the knee pad 200. The bottom of the individual boot strap may comprise a bottom coupler 232 for detachably coupling to the work boot 910. As non-limiting examples, the bottom coupler 232 may couple to the work boot 910 via a lacing hook, a lacing D-ring, an eyelet, a shoelace, or any combination thereof. As a non-limiting example, an individual coupler selected from the top coupler 230 and the bottom coupler 232 may be a snap hook, a carabiner, or any combination thereof. In some embodiments, the individual coupler may comprise a swivel 236.

As non-limiting examples, the pair of leg straps, the pair of boot straps, or both may be made of leather, polypropylene, polyester, nylon, cotton, acrylic, polyvinyl chloride, or any combination thereof.

Two of the knee pads 200 may be adapted to be worn as a pair—one for each of the user's knees 952.

In use, a user 950 may don the invention 100 on one of the user's knees 952 by positioning the knee pad 200 over the front of the user's knee 952 and by fastening the pair of leg straps behind the user's leg 954. The tops of the pair of boot straps may be coupled to the bottom of the knee pad 200 and the bottoms of the pair of boot straps may be coupled to a work boot 910. The process may be repeated to fasten a second knee pad to the 19 other knee.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used in this disclosure, the word "buckle" may refer to any fastener that is used for joining a first loose end of a strap to a second loose end of the same strap or to a loose end of a different strap.

As used herein, the words "couple", "couples", "coupled" or "coupling", may refer to connecting, either directly or indirectly, and does not necessarily imply a mechanical connection.

As used herein, "ellipse" may refer to a plane curve surrounding two focal points, such that for all points on the curve, the sum of the two distances to the focal points is a constant. Ellipses vary in shape from very broad and flat to almost circular, depending on how far away the foci are from each other. If the two foci are on the same spot, the ellipse is a circle and therefore a circle is considered a special case of an ellipse. An object that is substantially the shape of an ellipse may be described as elliptical.

As used herein, an "eyelet" may be a hole intended to receive a string, rope, cord, spring, or hook or a ring intended to reinforce such a hole.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used herein, "oblong" may refer to an object that is elongated.

As used in this disclosure, an "oval" may be a geometric shape that is formed in the shape of a flattened circle, similar in form to an ellipse. The shape may also sometimes be described as egg shaped. The difference between an oval and an ellipse is that an ellipse can be described by a mathematical formula while an oval has no such description.

As used in this disclosure, a "pad" may be a mass of soft material used as a filling, as insulation, or for protection against damage or injury. Commonly used padding materials include, but are not limited to, polyurethane foam, silicone, a polyester fill often referred to as fiberfill or polystyrene beads often referred to as stuffing beans or as bean bag chair beans.

As used in this disclosure, a "pitched roof" may refer to a roof wherein the surface of the roof forms an angle relative to the horizon.

As used in this disclosure, the term "rounded" may refer to the replacement of an apex, vertex, or edge or brink of a structure with a (generally smooth) curvature wherein the concave portion of the curvature faces the interior or center of the structure.

As used in this disclosure, a "slot" may be a prism-shaped negative space formed as a groove, cut, opening, or aperture in or through an object.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A knee protection assembly comprising:

a knee pad, a pair of leg straps, and a pair of boot straps;

wherein the knee pad is adapted to be worn by a user to protect a user's knee;

wherein the knee pad is adapted to cover a front of the user's knee;

wherein the knee pad is held in place by the pair of leg straps;

wherein the pair of boot straps are adapted to couple the knee pad to a work boot in order to prevent the knee pad from riding up a user's leg when working on a pitched roof;

wherein the knee pad comprises a plurality of lower strap interfaces located on the bottom sides of the knee pad;

wherein a lower leg strap couples to the plurality of lower strap interfaces to retain the lower leg strap;

wherein each of the plurality of lower strap interfaces comprise a boot strap aperture for coupling the pair of boot straps to the knee pad.

2. The knee protection assembly according to claim 1 wherein the knee pad is a covering adapted to fit over the front of the user's knee;

wherein the knee pad is padded such that the knee pad is adapted to cushion the user's knee while kneeling.

3. The knee protection assembly according to claim 2 wherein the knee pad is oblong and rounded.

4. The knee protection assembly according to claim 2 wherein the knee pad is concave such that the knee pad is adapted for the user's knee to fit into the knee pad when the user's knee is bent.

5. The knee protection assembly according to claim 2 wherein the knee pad is held in place by the pair of leg straps.

6. The knee protection assembly according to claim 5 wherein the knee pad comprises a plurality of upper strap interfaces located on the top sides of the knee pad;

wherein an upper leg strap couples to the plurality of upper strap interfaces to retain the upper leg strap.

7. The knee protection assembly according to claim 6 wherein the plurality of upper strap interfaces are slots that the upper leg strap passes through.

8. The knee protection assembly according to claim 7 wherein the plurality of lower strap interfaces are slotted tabs that the lower leg strap passes through.

9. The knee protection assembly according to claim 8 wherein the pair of leg straps comprises the upper leg strap and the lower leg strap;

wherein the upper leg strap is a flexible, horizontally-oriented strap adapted to encircle the back of the user's leg above the user's knee;

wherein both ends of the upper leg strap couple to the knee pad;

wherein the lower leg strap is a flexible, horizontally-oriented strap adapted to encircle the back of the user's leg below the user's knee;

wherein both ends of the lower leg strap couple to the knee pad.

10. The knee protection assembly according to claim 9 wherein an individual leg strap selected from the upper leg strap and the lower leg strap separates at a leg strap fastener for donning and removal;

wherein the leg strap fastener is operable to adjust the length of the individual leg strap.

11. The knee protection assembly according to claim 10 wherein the pair of boot straps comprises a left side boot strap and a right side boot strap;

wherein the left side boot strap and the right side boot strap are a flexible, vertically-oriented straps adapted to prevent the knee pad from riding up the user's leg;

wherein the tops of the left side boot strap and the right side boot strap couple to the knee pad;

wherein the bottoms of the left side boot strap and the right side boot strap couple to the work boot;

wherein the left side boot strap is coupled to the bottom left side of the knee pad;

wherein the right side boot strap is coupled to the bottom right side of the knee pad.

12. The knee protection assembly according to claim 11 wherein an individual boot strap selected from the left side boot strap and the right side boot strap separates at a boot strap fastener for donning and removal;

wherein the boot strap fastener is operable to adjust the length of the individual boot strap.

13. The knee protection assembly according to claim 12 wherein the top of the individual boot strap comprises a top coupler for detachably coupling to the knee pad; wherein the bottom of the individual boot strap comprises a bottom coupler for detachably coupling to the work boot.

14. The knee protection assembly according to claim 13 wherein an individual coupler selected from the top coupler and the bottom coupler is a snap hook, a carabiner, or any combination thereof.

15. The knee protection assembly according to claim 14 wherein the individual coupler comprises a swivel.

16. The knee protection assembly according to claim 14 wherein the pair of leg straps, the pair of boot straps, or both are made of leather, polypropylene, polyester, nylon, cotton, acrylic, polyvinyl chloride, or any combination thereof.

17. The knee protection assembly according to claim 14 wherein two of the knee pads are adapted to be worn as a pair—one for each of the user's knees.

* * * * *